US008919127B2

(12) United States Patent
Melton et al.

(10) Patent No.: US 8,919,127 B2
(45) Date of Patent: Dec. 30, 2014

(54) SYSTEM AND METHOD FOR FLOW CONTROL IN GAS TURBINE ENGINE

(75) Inventors: Patrick Benedict Melton, Horse Shoe, NC (US); Ronald James Chila, Greer, SC (US); Abdul Rafey Khan, Greenville, SC (US); Carolyn Ashley Antoniono, Greenville, SC (US)

(73) Assignee: General Electric Company, Schenectady, NY (US)

( * ) Notice: Subject to any disclaimer, the term of this patent is extended or adjusted under 35 U.S.C. 154(b) by 814 days.

(21) Appl. No.: 13/115,058

(22) Filed: May 24, 2011

(65) Prior Publication Data

US 2012/0297785 A1 Nov. 29, 2012

(51) Int. Cl.

| | |
|---|---|
| ***F02C 1/00*** | (2006.01) |
| ***F02G 3/00*** | (2006.01) |
| ***F23R 3/02*** | (2006.01) |
| ***F23R 3/28*** | (2006.01) |

(52) U.S. Cl.

CPC .. *F23R 3/02* (2013.01); *F23R 3/286* (2013.01)
USPC ..... 60/755; 60/742; 60/754; 60/758; 60/757; 60/756; 60/760; 60/772; 60/740; 60/737; 415/115; 416/92; 416/96 R; 416/97 R

(58) Field of Classification Search

USPC ..... 60/752–760, 796, 742, 740, 737; 415/115; 416/92, 96 R, 97 R
See application file for complete search history.

(56) References Cited

U.S. PATENT DOCUMENTS

| | | | | |
|---|---|---|---|---|
| 2,621,477 | A | 12/1952 | Powter et al. | |
| 2,722,803 | A | 11/1955 | Travers | |
| 2,818,704 | A | 1/1958 | Karcher | |
| 2,958,194 | A | 11/1960 | Bayley | |
| 2,993,337 | A | 6/1961 | Cheeseman | |
| 3,099,134 | A | 7/1963 | Calder et al. | |
| 3,779,199 | A | 12/1973 | Mayer, Jr. | |
| 4,813,635 | A | 3/1989 | Paterson et al. | |
| 5,579,645 | A | 12/1996 | Proc | |
| 5,647,215 | A | 7/1997 | Foss et al. | |
| 6,004,095 | A | 12/1999 | Waitz et al. | |
| 6,059,530 | A * | 5/2000 | Lee | 416/97 R |
| 6,192,688 | B1 | 2/2001 | Beebe | |
| 6,279,313 | B1 | 8/2001 | Lawen, Jr. et al. | |

(Continued)

FOREIGN PATENT DOCUMENTS

| | | | |
|---|---|---|---|
| EP | 1167882 | A1 | 1/2002 |
| EP | 2527742 | A2 | 11/2012 |

(Continued)

OTHER PUBLICATIONS

U.S. Appl. No. 13/115,009, filed May 24, 2011, Cihlar et al.

(Continued)

*Primary Examiner* — Craig Kim
(74) *Attorney, Agent, or Firm* — Fletcher Yoder P.C.

(57) ABSTRACT

A system includes a gas turbine combustor, which includes a combustion liner disposed about a combustion region, a flow sleeve disposed about the combustion liner, an air passage between the combustion liner and the flow sleeve, and a structure between the combustion liner and the flow sleeve. The structure obstructs an airflow through the air passage. The gas turbine combustor also includes a wake reducer disposed adjacent the structure. The wake reducer directs a flow into a wake region downstream of the structure.

19 Claims, 4 Drawing Sheets

(56) References Cited

U.S. PATENT DOCUMENTS

| | | | | |
|---|---|---|---|---|
| 6,334,294 | B1 | 1/2002 | Belsom et al. | |
| 6,409,126 | B1 | 6/2002 | Cunningham, Jr. | |
| 6,720,687 | B2 | 4/2004 | Salamah et al. | |
| 6,843,059 | B2 | 1/2005 | Burrus et al. | |
| 6,868,676 | B1 * | 3/2005 | Haynes | 60/776 |
| 6,896,475 | B2 | 5/2005 | Grazios et al. | |
| 6,979,049 | B2 | 12/2005 | Ortega et al. | |
| 7,152,829 | B2 | 12/2006 | Bertolotti | |
| 7,665,797 | B1 | 2/2010 | Brosseau | |
| 7,886,541 | B2 | 2/2011 | Woolford et al. | |
| 8,220,246 | B2 | 7/2012 | Widener | |
| 8,276,391 | B2 | 10/2012 | Berry et al. | |
| 8,387,396 | B2 | 3/2013 | Chen et al. | |
| 8,397,514 | B2 * | 3/2013 | Crawley et al. | 60/772 |
| 2007/0062198 | A1 | 3/2007 | Huth et al. | |
| 2008/0034759 | A1 | 2/2008 | Bulman et al. | |
| 2010/0037620 | A1 | 2/2010 | Chila | |
| 2011/0016869 | A1 | 1/2011 | Iwasaki | |
| 2011/0079013 | A1 | 4/2011 | Mehring | |
| 2012/0297783 | A1 * | 11/2012 | Melton et al. | 60/772 |

FOREIGN PATENT DOCUMENTS

| | | | |
|---|---|---|---|
| GB | 616481 | A | 1/1949 |
| JP | 55393214 | A | 8/1978 |
| JP | S5960127 | A | 4/1984 |
| JP | 2004317008 | A | 11/2004 |

OTHER PUBLICATIONS

U.S. Appl. No. 13/115,018 filed May 24, 2011, Melton et al.

U.S. Appl. No. 13/115,051, filed May 24, 2011, Melton et al.

U.S. Appl. No. 13/115,063, filed May 24, 2011, Crawley et al.

Search Report and Written Opinion from EP Application No. 12168558.0 dated Aug. 21, 2013.

* cited by examiner

SYSTEM AND METHOD FOR FLOW CONTROL IN GAS TURBINE ENGINE

BACKGROUND OF THE INVENTION

The subject matter disclosed herein relates to combustion systems, and, more particularly, to flow control within gas turbine engines.

Various combustion systems include combustion chambers in which fuel and air combust to generate hot gases. For example, a gas turbine engine may include one or more combustion chambers that are configured to receive compressed air from a compressor, inject fuel into the compressed air, and generate hot combustion gases to drive the turbine engine. Each combustion chamber may include one or more fuel nozzles, a combustion zone within a combustion liner, a flow sleeve surrounding the combustion liner, and a gas transition duct. Compressed air from the compressor flows to the combustion zone through a gap between the combustion liner and the flow sleeve. Structures may be disposed in the gap to accommodate various components, such as crossfire tubes, flame detectors, and so forth. Unfortunately, flow disturbances may be created as the compressed air passes by such structures, thereby decreasing performance of the gas turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine combustor, which includes a combustion liner disposed about a combustion region, a flow sleeve disposed about the combustion liner, an air passage between the combustion liner and the flow sleeve, and a structure between the combustion liner and the flow sleeve. The structure obstructs an airflow through the air passage. The gas turbine combustor also includes a wake reducer disposed adjacent the structure. The wake reducer directs a flow into a wake region downstream of the structure.

In a second embodiment, a system includes a turbine wake reducer configured to reduce a wake in a wake region downstream from a structure obstructing a gas flow of a gas turbine engine. The turbine wake reducer includes a flow control wall configured to surround the structure, an upstream opening configured to intake a portion of the gas flow into an intermediate passage between the flow control wall and the structure, and a downstream opening configured to exhaust the portion of the gas flow into the wake region.

In a third embodiment, a method includes reducing a wake in a wake region downstream from a structure that obstructs an airflow between a combustion liner and a flow sleeve of a gas turbine combustor. Reducing the wake includes redirecting a portion of the airflow from an upstream opening, through an intermediate passage, and out through a downstream opening into the wake region.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
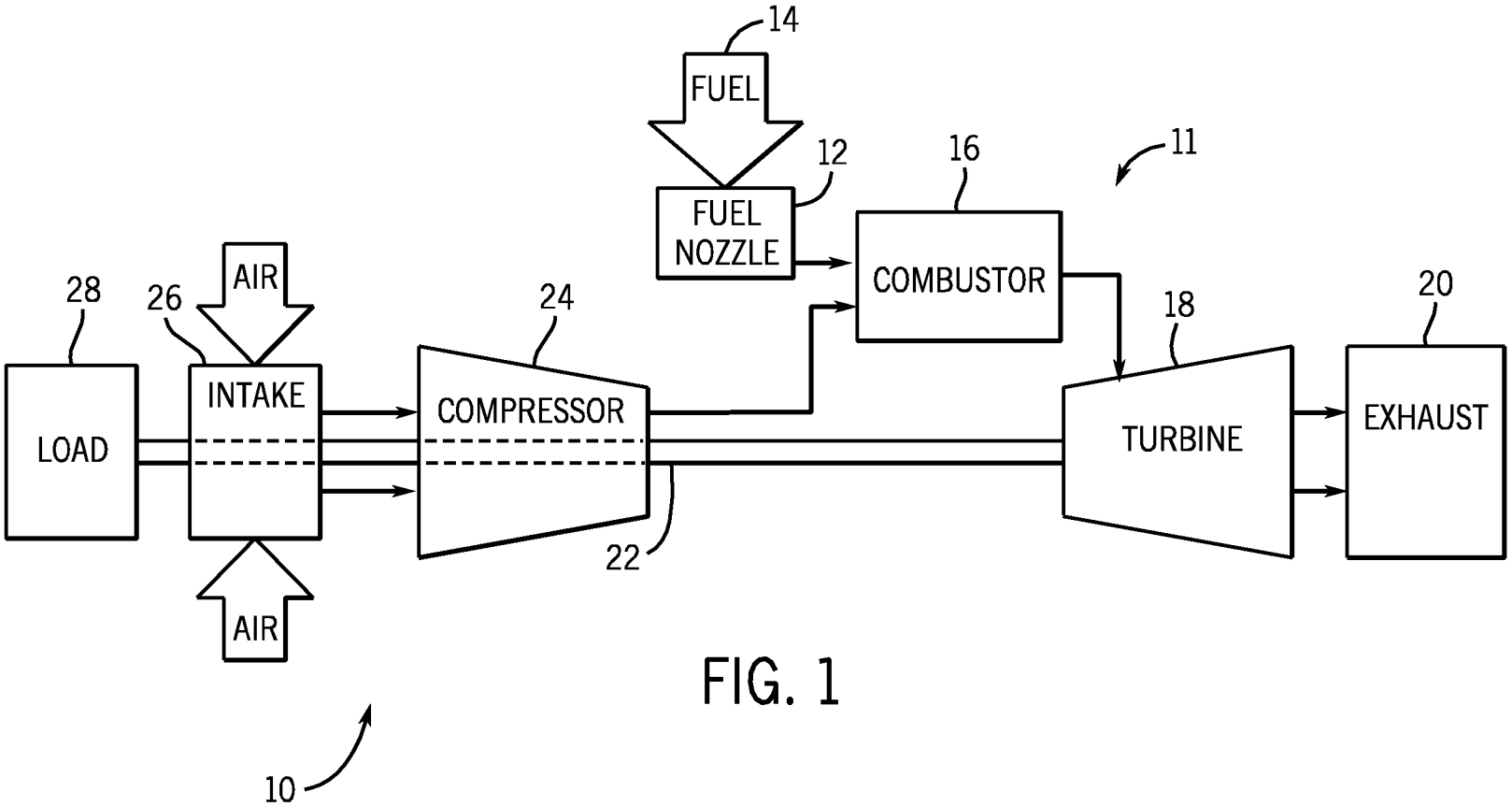
FIG. 1 is a block diagram of an embodiment of a turbine system having a combustor.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments provide systems and methods for reducing a wake in a wake region downstream from a structure obstructing a gas flow. For example, the structure may obstruct an airflow between a combustion liner and a flow sleeve of a gas turbine combustor of a gas turbine engine. A wake reducer may be disposed adjacent to (or partially surrounding) the structure and direct a flow into the wake region downstream of the structure. The wake reducer may include upstream and downstream openings. The upstream opening may be configured to intake a portion of the gas flow into an intermediate passage between the wake reducer and the structure. The downstream opening may be configured to exhaust a portion of the gas flow into the wake region. In the disclosed embodiments, the wake downstream of the structure is essentially filled with a higher velocity fluid, namely the portion of the gas flow exhausted from the downstream opening. Filling of the wake with the exhausted gas flow helps to reduce the size and formation of the wake. In addition, boundary layer blowing may be used at strategic locations to delay flow separation and reduce the lateral spreading of the wake.

Reducing the wake in the wake region downstream from the structure may offer several benefits. For example, fuel injected downstream of the structure may be pulled into the wake. The fuel may accumulate in the wake and cause flame holding, thereby decreasing performance of the gas turbine engine. In addition, the presence of wakes may result in a higher pressure drop across the combustion liner. The presently disclosed embodiments employ the wake reducer to reduce wakes and avoid the disadvantages of other methods of wake reduction. For example, using the wake reducer may reduce the possibility of flame holding, increase the gas turbine engine performance, and decrease the pressure drop across the combustion liner. In addition, the wake reducer may be less expensive, less complicated, easier to manufacture and install, and more reliable than other methods of wake reduction. Thus, use of the disclosed wake reducers is particularly well suited for reducing wakes in gas turbine engines and other combustion systems.

FIG. 1 is a block diagram of an embodiment of a turbine system 10 having a gas turbine engine 11. As described in detail below, the disclosed turbine system 10 employs one or more combustors 16 with an improved design to reduce wakes within an air supply passage of the combustor 16. The turbine system 10 may use liquid or gas fuel, such as natural gas and/or a synthetic gas, to drive the turbine system 10. As depicted, one or more fuel nozzles 12 intake a fuel supply 14, partially mix the fuel with air, and distribute the fuel and air mixture into the combustor 16 where further mixing occurs between the fuel and air. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 is connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of turbine system 10.

Figure 2:
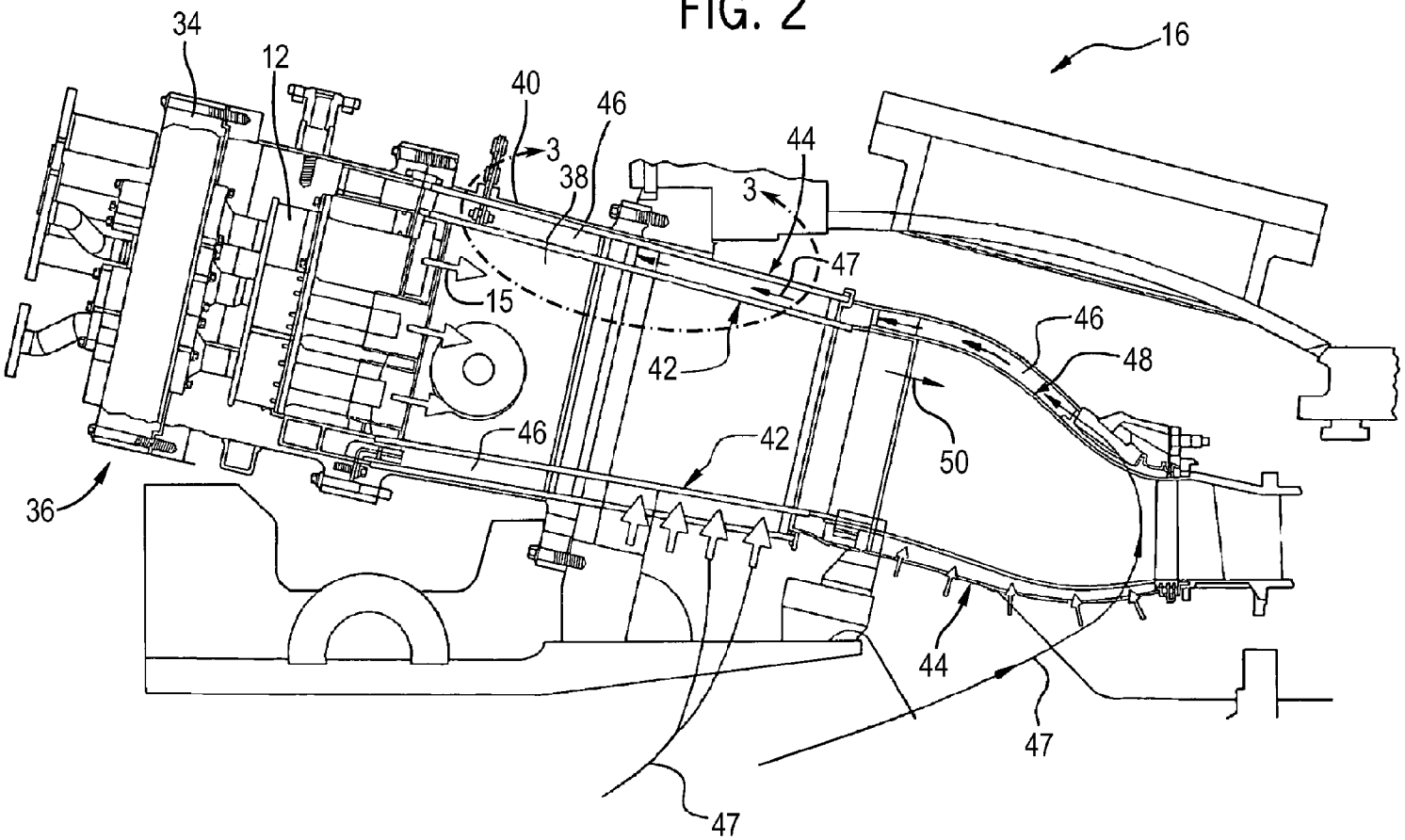
FIG. 2 is a cutaway side view of an embodiment of the turbine system as illustrated in FIG. 1, further illustrating details of the combustor.

FIG. 2 is a cutaway side view of an embodiment of the combustor 16 of the gas turbine engine 11, as illustrated in FIG. 1. As illustrated, one or more fuel nozzles 12 are located inside the combustor 16, wherein each fuel nozzle 12 is configured to partially premix air and fuel within intermediate or interior walls of the fuel nozzles 12 upstream of the injection of air, fuel, or an air-fuel mixture into the combustor 16. For example, each fuel nozzle 12 may divert fuel into air passages, thereby partially premixing a portion of the fuel with air to reduce high temperature zones and nitrogen oxide ($NO_x$) emissions. Further, the fuel nozzles 12 may inject a fuel-air mixture 15 into the combustor 16 in a suitable ratio for optimal combustion, emissions, fuel consumption, and power output.

As illustrated in FIG. 2, the plurality of fuel nozzles 12 is attached to an end cover 34, near a head end 36 of the combustor 16. Compressed air and fuel are directed through the end cover 34 and the head end 36 to each of the fuel nozzles 12, which distribute the fuel-air mixture 15 into a combustion chamber 38 of the combustor 16. The combustion chamber 38, or combustion region, is generally defined by a combustion casing 40, a combustion liner 42, and a flow sleeve 44. As shown in FIG. 2, the flow sleeve 44 is disposed about the combustion liner 42. In certain embodiments, the flow sleeve 44 and the combustion liner 42 are coaxial with one another to define a hollow annular space 46, or annular air passage, which may enable passage of air 47 for cooling and for entry into the head end 36 and the combustion chamber 38. As discussed below, one or more wake reducers may be disposed in the hollow annular space 46 to reduce the wake associated with protruding structures in the space 46. For example, the wake reducers may partially surround the protruding structures to guide the airflow into the wake region, and thus fill the wake region with airflow to reduce the wake. In this manner, the wake reducer helps improve the flow, air-fuel mixing, and combustion downstream of the wake reducer. For example, downstream of the wake reducers, the fuel nozzles 12 inject fuel and air into the combustion chamber 38 to generate hot combustion gases, which then flow through the transition piece 48 to the turbine 18, as illustrated by arrow 50. The combustion gases then drive rotation of the turbine 18 as discussed above.

Figure 3:
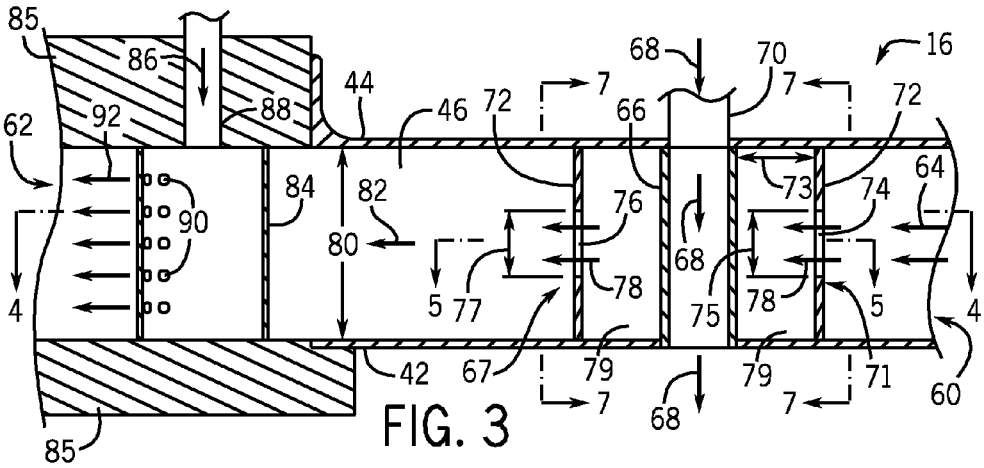
FIG. 3 is a partial cross-sectional side view of an embodiment of the combustor as illustrated in FIG. 2, taken within line 3-3, illustrating a wake reducer.

FIG. 3 is a partial cross-sectional side view of an embodiment of the combustor 16 as illustrated in FIG. 2 taken within line 3-3. As illustrated, the combustor 16 includes an upstream side 60 that receives a compressed airflow 64, and a downstream side 62 that outputs the compressed airflow 64 to the head end 36. Specifically, an airflow 64 enters the upstream side 60 of the annular space 46. Moving downstream from the upstream side 60, a structure 66 extends between the combustion liner 42 and the flow sleeve 44. The structure 66 obstructs the airflow 64 flowing through the annular space 46, creating a wake in a wake region 67 located downstream from the structure 66. The wake region 67 is a region of recirculating flow immediately behind the structure 66, caused by the flow of surrounding fluid around the structure 66. The structure 66 may include, but it not limited to, a cross-fire tube, a flame detector, a spark plug, a boss, a spacer, a pressure probe, a late lean injector, a sensor, or any similar object that may be found in the annular space 46 of the combustor 16 and that is capable of obstructing the airflow 64. In the illustrated embodiment, the structure 66 corresponds to a cross-fire tube, which extends between the combustor 16 and another combustor of the gas turbine engine 11. In other embodiments, the structure 66 may correspond to other internal flow passages similar to the cross-fire tube. Although the following discussion refers to the structure 66 as the cross-fire tube, in various embodiments, the structure 66 may correspond to any of the examples of structures 66 listed above. Returning to FIG. 3, a flame 68 from the other combustor is directed through an external portion 70 of the cross-fire tube 66 to the combustor 16 to ignite the air-fuel mixture in the combustion chamber 38.

A wake reducer 71 may be disposed adjacent to the cross-fire tube 66 to reduce the wake in the wake region 67 downstream from the cross-fire tube 66. Specifically, the wake reducer 71 may include a flow control wall 72, or baffle, disposed about the cross-fire tube 66. The flow control wall 72 is offset by a distance 73 from the cross-fire tube 66. The distance 73 may be adjusted to provide a desired reduction of the wake extending from the cross-fire tube 66. In certain embodiments, the flow control wall 72 may extend (e.g., curve) around the cross-fire tube 66 from the upstream side 60 to the downstream side 62 of the cross-fire tube 66. The upstream side 60 of the cross-fire tube 66 may also be referred to as a leading edge or front end. Similarly, the downstream side 62 of the cross-fire tube 66 may also be referred to as a trailing edge or back end. The wake reducer 71 also includes an upstream opening 74 that intakes a portion of the airflow 64. The upstream opening 74 is defined by an upstream height 75, which may be adjusted to provide the desired reduction of the wake extending from the cross-fire tube 66. Further, the wake reducer 71 includes a downstream opening 76 that exhausts the portion of the airflow 64 into the wake region 67 downstream from the cross-fire tube 66. The downstream opening 76 is defined by a downstream height 77, which may or may not be the same as the upstream height 75 of the upstream opening 74. The downstream height 77 of the downstream opening 76 may be adjusted to achieve the desired reduction of the wake extending from the cross-fire tube 66. Further, in certain embodiments, the upstream height 75 and/or the downstream height 77 may be approximately the same as a radial distance 80 between the combustion liner 42 and the flow sleeve 44. In other words, the upstream and downstream openings 74 and 76 may extend the distance 80 of the annular space 46. In addition, as described in detail below, certain embodiments may include a plurality of upstream and downstream openings 74 and 76.

When the airflow 64 encounters the wake reducer 71, a portion 78 of the airflow 64 enters through the upstream opening 74. A remaining portion of the airflow 64 bypasses the wake reducer 71. The portion 78 of the airflow 64 then enters an intermediate passage 79 located between the upstream opening 74 and the downstream opening 76. The intermediate passage 79 may be defined between the cross-fire tube 66 and the wake reducer 71, or flow control wall 72. In certain embodiments, the flow control wall 72 disposed about the cross-fire tube 66 defines the intermediate passage 79. Thus, the flow control wall 72 includes the upstream opening 74 and the downstream opening 76. The portion 78 then exhausts through the downstream opening 76 and fills the wake region 67.

The portion 78 exhausting through the downstream opening 76 may combine with the remaining portion of the airflow 64 that bypassed the wake reducer 71 to form the downstream airflow 82 in the wake region 67 extending from the cross-fire tube 66. Specifically, the wake reducer 71 may reduce a wake in the downstream airflow 82. In certain embodiments, the downstream airflow 82 may encounter one or more fuel injectors 84 disposed downstream of the cross-fire tube 66, the combustion liner 42, and the flow sleeve 44. Specifically, the fuel injectors 84 may be located in an annulus formed by a cap 85. In certain embodiments, the fuel injector 84 may be a quaternary injector that injects a portion of a fuel 86 into the downstream airflow 82 upstream from the fuel nozzles 12. The fuel 86 may be carried to the fuel injector 84 through a fuel manifold 88. In certain embodiments, one or more fuel openings 90 may be disposed in the fuel injector 84 facing toward the downstream side 62 of the combustor 16. The fuel 86 may mix with the downstream airflow 82 to form an air-fuel mixture 92 that then flows to the fuel nozzles 12.

Figure 4:
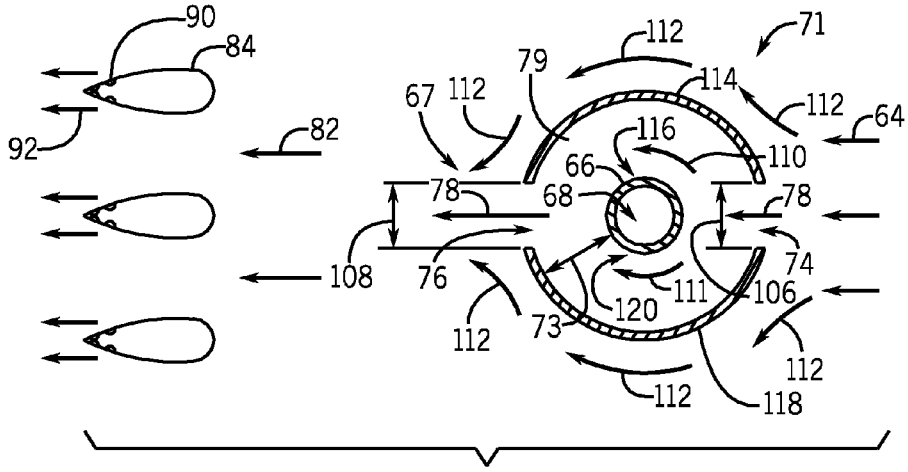
FIG. 4 is a cross-sectional top view of an embodiment of a wake reducer and a plurality of fuel injectors taken along line 4-4 of FIG. 3.

FIG. 4 is a top cross-sectional view of an embodiment of the wake reducer 71 and the fuel injectors 84 along the line labeled 4-4 in FIG. 3. As shown in FIG. 4, the upstream opening 74 is defined by an upstream width 106. Similarly, the downstream opening 76 is defined by a downstream width 108. The upstream and downstream widths 106 and 108 may be adjusted to achieve the desired reduction of the wake in the downstream airflow 82. In certain embodiments, the upstream and downstream widths 106 and 108 may be equal or different from one another. In the illustrated embodiment, both the wake reducer 71 and the cross-fire tube 66 have a circular cross-sectional shape. In other embodiments, as discussed in detail below, the wake reducer 71 and/or cross-fire tube 66 may have other cross-sectional shapes, such as oval, tapered, aerodynamic, or airfoil shapes. Further, the cross-fire tube 66 is located concentrically within the wake reducer 71 in the illustrated embodiment. In other words, the wake reducer 71 and the cross-fire tube 66 are generally coaxial with one another. Thus, the offset distance 73 may be approximately the same all the way around the cross-fire tube 66 when both the wake reducer 71 and the cross-fire tube 66 both have circular cross-sectional shapes. In other embodiments, the wake reducer 71 and/or the cross-fire tube 66 may not be coaxial with one another.

As shown in FIG. 4, the portion 78 of the airflow 64 enters the upstream opening 74. Upon reaching the cross-fire tube 66, the portion 78 divides into a first flow 110 and a second flow 111 in the intermediate passage 79. The first and second flows 110 and 111 combine near the downstream opening 76. In certain embodiments, more than one cross-fire tube 66 may be located within the wake reducer 71. In such embodiments, first and second flows 110 and 111 may exist around each of the cross-fire tubes 66. As shown in FIG. 4, not all of the airflow 64 enters the first opening 74 of the wake reducer 71. Instead, a bypass portion 112 of the airflow 64 flows around and bypasses the intermediate passage 79 of the wake reducer 71. The bypass portion 112 may combine with the portion 78 exiting the downstream opening 76 to form the downstream airflow 82. Thus, the bypass portion 112 and the portion 78 exiting through the downstream opening 76 may combine to fill the wake region 67 downstream of the cross-fire tube 66, thereby reducing flow separation and reducing lateral spreading of the wake. In other words, without the wake reducer 71, the wake region 67 may include low velocity fluid, whereas the portion 78 and the bypass portion 112 may be higher velocity fluids.

Returning to the intermediate passage 79 illustrated in FIG. 4, the flow control wall 72 includes a first wall portion 114 disposed adjacent to a first side 116 of the cross-fire tube 66. Similarly, the flow control wall 72 includes a second wall portion 118 disposed adjacent to a second side 120 of the cross-fire tube 66. The first and second sides 116 and 120 of the cross-fire tube 66 are opposite from one another. The first wall portion 114 extends between the upstream opening 74 and the downstream opening 76 on the first side 116 of the cross-fire tube 66. Similarly, the second wall portion 118 extends between the upstream opening 74 and the downstream opening 76 on the second side 120 of the cross-fire tube 66. In the illustrated embodiment, the first and second wall portions 114 and 118 first diverge and then converge toward one another (e.g., diverging-converging surfaces) along the first and second flows 110 and 111 from the upstream opening 74 toward the downstream opening 76. As the portion 78 of the airflow exits the downstream opening 76, it energizes the wake region 67 by filling the region 67 with high velocity airflow. In this manner, the wake reducer 71 substantially reduces or eliminates a low velocity recirculation zone downstream of the cross-fire tube 66.

As shown in FIG. 4, the annular space 46 may include more than one fuel injector 84. Each of the fuel injectors 84 may have an aerodynamic cross-sectional shape. Such a configuration of the fuel injectors 84 may reduce a wake in the air-fuel mixture 92 downstream of the fuel injectors 84. Reduction of the wake in the wake region 67 behind the cross-fire tube 66 using the wake reducer 71 may offer several benefits. For example, less of the fuel 86 may be pulled into the wake region 67 behind the cross-fire tube 66. This may reduce the possibility of flame holding of the gas turbine engine 11 and/or enable a higher percentage of fuel injection for increased performance of the gas turbine engine 11. In addition, the overall pressure drop through the annular space 46 may be reduced through reduction of the wake by the wake reducer 71. Thus, use of the wake reducer 71 may improve uniformity of airflow and air-fuel mixing upstream of the head end 36, thereby improving airflow and air-fuel mixing in the fuel nozzles 12.

Figure 5:
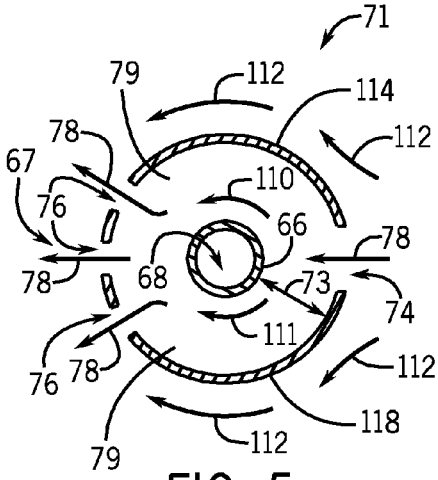
FIG. 5 is a cross-sectional top view of an embodiment of a wake reducer.

FIG. 5 is a top cross-sectional view of another embodiment of the wake reducer 71. As shown, the wake reducer 71 includes three downstream openings 76. Such a configuration of the wake reducer 71 may fill the low velocity wake region 67 downstream of the cross-fire tube 66 more completely and/or at a faster rate, thereby further reducing the wake behind the cross-fire tube 66. Each of the downstream openings 76 may be identical or different from one another. For example, the downstream heights 76 and/or downstream widths 108 of the downstream openings 76 may be the same or differ from one another. Further, as discussed in detail below, the shapes of the downstream openings 76 may be the same or differ from one another. In various embodiments, the wake reducer 71 may include two, three, four, five, or more downstream openings 76 (e.g., 2 to 50 openings 76). The number of downstream openings 76 may be adjusted to achieve the desired reduction of the wake extending from the cross-fire tube 66.

Figure 6:
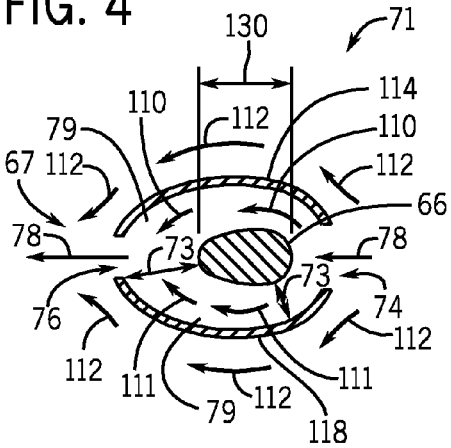
FIG. 6 is a cross-sectional top view of an embodiment of a wake reducer.

FIG. 6 is a top cross-sectional view of a further embodiment of the wake reducer 71. As shown, both the wake reducer 71 and the structure 66 have oval cross-sectional shapes. In other words, the wake reducer 71 and the structure 66 may have a bullet shape, an airfoil shape, an elongated shape, or other similar shape. Thus, the cross-sectional shapes of the wake reducer 71 and the structure 66 in the illustrated embodiment are not circular. The oval cross-sectional shape of the wake reducer 71 may further help reduce the wake in the wake region 67. Although an oval cross-sectional shape of the structure 66 may reduce the wake, use of the wake reducer 71 together with the structure 66 may enable a length 130 of the structure 66 to be reduced. Further, the structure 66 shown in FIG. 6 does not include an internal opening, such as that of the cross-fire tube shown in previous embodiments. Instead, the structure 66 may be a solid object, such as a flame detector, a spark plug, a boss, a spacer, a pressure probe, a late lean injector, or a sensor, for example. Moreover, in the illustrated embodiment, the offset distance 73 is not constant all the way around the structure 66. For example, the offset distance 73 near the upstream opening 74 may be smaller than the offset distance 73 near the downstream opening 76. In other embodiments, the offset distance 73 near the upstream opening 74 may be greater than the offset distance 73 near the downstream opening 76. In other respects, the embodiment of the wake reducer 71 shown in FIG. 6 is similar to that of the previously discussed embodiments.

Figure 7:
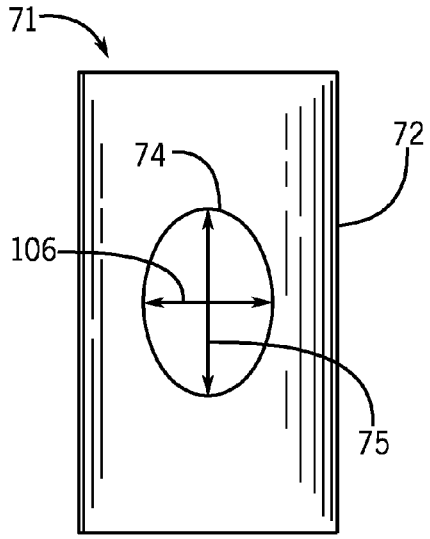
FIG. 7 is a side elevational view of an opening of an embodiment of a wake reducer, as indicated by lines 7-7 of FIG. 3.

FIG. 7 is a side elevational view of an embodiment of the wake reducer 71 along the lines labeled 7-7 in FIG. 3. Thus, FIG. 7 shows either the upstream opening 74 or the downstream opening 76 or both. However, the following discussion will only refer to the upstream opening 74, although the comments below may also apply to the downstream opening 76. As shown in FIG. 7, the upstream opening 74 is defined by the upstream height 75 and upstream width 106. Further, the upstream opening 74 has an oval cross-sectional shape. In other words, the upstream height 75 is greater than the upstream width 106. In further embodiments, the cross-sectional shape of the upstream opening 74 may be circular or have another shape. As discussed above, the configuration of the downstream opening 76 may be similar to or different from the upstream opening 74.

Figure 8:
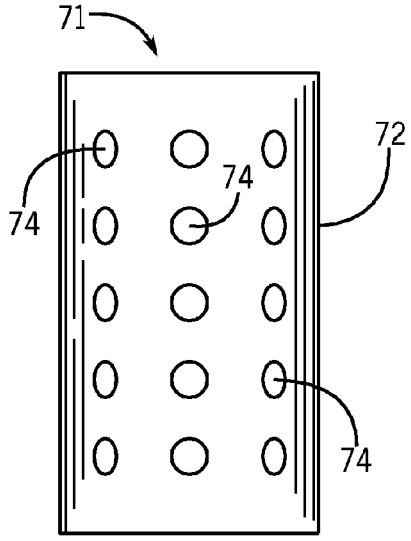
FIG. 8 is a side elevational view of openings of an embodiment of a wake reducer, as indicated by lines 7-7 of FIG. 3.

FIG. 8 is a side elevational view of an embodiment of the wake reducer 71 along the lines labeled 7-7 in FIG. 3. As shown, the wake reducer 71 includes a plurality of upstream openings 74. As shown, all of the upstream openings 74 may have a circular cross-sectional shape. Further, the upstream height 75 and/or upstream width 106 of the upstream opening 74 may all be the same or may be different from one another. The use of a plurality of upstream openings 74 may affect the wake advantageously in certain situations. For example, in certain embodiments, use of a plurality of upstream openings 74 may reduce the pressure drop across the wake reducer 71. The downstream openings 76 may be configured similarly to or differently from the upstream openings 74 shown in FIG. 8. In certain embodiments, the upstream and downstream openings 74 and 76 may be disposed all the way around the wake reducer 71.

Figure 9:
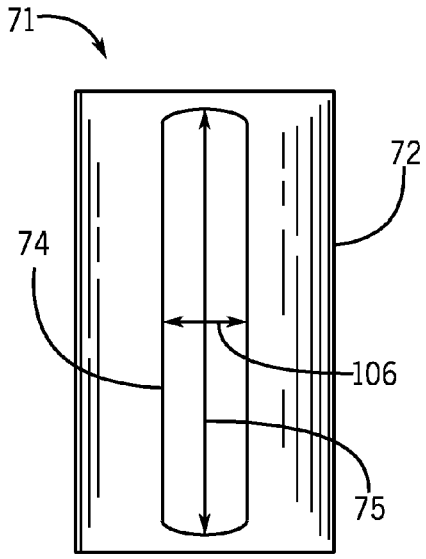
FIG. 9 is a side elevational view of an opening of an embodiment of a wake reducer, as indicated by lines 7-7 of FIG. 3.

FIG. 9 is a side elevational view of another embodiment of the wake reducer 71 along the lines labeled 7-7 in FIG. 3. As shown, the upstream opening 74 has a slot or rectangular shape. In other words, the upstream height 75 may be greater than the upstream width 106 of the upstream opening 74. In addition, the sides of the upstream openings 74 may be generally straight, which may simplify manufacturing of the wake reducer 71. In the illustrated embodiment, the upstream height 75 may extend partially the distance 80 between the flow sleeve 44 and the combustion liner 42. In other embodiments, the upstream opening 74 may extend completely the distance 80 between the combustion liner 42 and the flow sleeve 44. In certain embodiments, the downstream opening 76 may be shaped similarly to or differently from the upstream opening 74 shown in FIG. 9.

Figure 10:
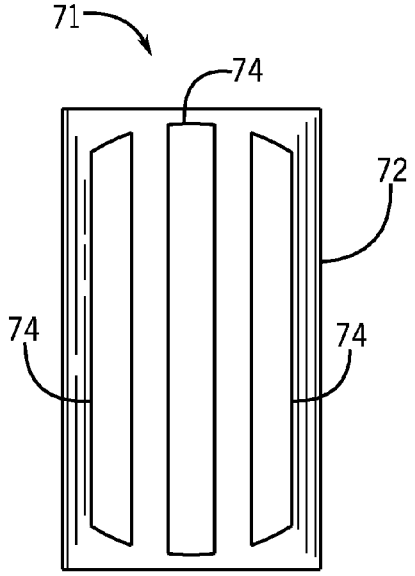
FIG. 10 is a side elevational view of openings of an embodiment of a wake reducer, as indicated by lines 7-7 of FIG. 3.

FIG. 10 is a side elevational view of a further embodiment of the wake reducer 71 along the lines labeled 7-7 in FIG. 3. As shown, the wake reducer 71 includes three upstream openings 74. Each of the upstream openings 74 may be configured to be identical or different from one another. By providing more upstream openings 74 and/or larger upstream openings 74, more of the airflow 64 may enter the intermediate passage 79. Similarly, using more downstream openings 76 and/or larger downstream openings 76 may enable more of the portion 78 to fill the low velocity wake region 67 downstream of the structure 66 to reduce the size of the wake. Although specific arrangements of the upstream opening 74 and/or downstream openings 76 are shown in the previous embodiments, further embodiments may include other configurations and numbers of the upstream and downstream openings 74 and 76.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine combustor, comprising:

a combustion liner disposed about a combustion region;

a flow sleeve disposed about the combustion liner;

an air passage between the combustion liner and the flow sleeve;

a structure between the combustion liner and the flow sleeve, wherein the structure obstructs an airflow through the air passage; and a wake reducer disposed adjacent the structure, wherein the wake reducer directs a flow into a wake region downstream of the structure, the wake reducer comprises an upstream opening configured to intake a portion of the airflow, a downstream opening configured to exhaust the portion of the airflow into the wake region, and an intermediate passage between the upstream opening and the downstream opening, and the intermediate passage is defined between the structure and the wake reducer.

2. The system of claim 1, wherein the wake reducer comprises a plurality of upstream openings configured to intake the portion of the airflow.

3. The system of claim 1, wherein the wake reducer comprises a plurality of downstream openings configured to exhaust the portion of the airflow into the wake region.

4. The system of claim 1, wherein the wake reducer comprises a flow control wall disposed about the structure to define the intermediate passage, and the flow control wall comprises the upstream opening and the downstream opening.

5. The system of claim 4, wherein the flow control wall comprises first and second wall portions disposed on opposite first and second sides of the structure, the first wall portion extends between the upstream opening and the downstream opening on the first side of the structure, and the second wall portion extends between the upstream opening and the downstream opening on the second side of the structure.

6. The system of claim 5, wherein the first and second wall portions converge toward one another along the airflow toward the downstream opening.

7. The system of claim 1, wherein the wake reducer comprises a flow control wall at an offset distance from the structure, and the flow control wall curves around the structure from an upstream side to a downstream side of the structure.

8. The system of claim 7, wherein the structure comprises an elongated structure having a circular cross-section, and the flow control wall comprises a circular wall disposed about the circular cross-section.

9. The system of claim 7, wherein the structure comprises an elongated structure having an oval cross-section or aerodynamic shaped cross-section, and the flow control wall comprises an oval wall or aerodynamic shaped wall disposed about the oval cross-section or the aerodynamic shaped cross-section.

10. The system of claim 1, wherein the wake reducer comprises a plurality of upstream or downstream openings configured to direct the flow into the wake region.

11. The system of claim 1, comprising a fuel injector disposed downstream of the combustion liner and the flow sleeve, wherein the fuel injector obstructs the airflow through the air passage downstream from the structure, and the wake reducer is configured to reduce a wake in the airflow from the structure.

12. The system of claim 1, wherein the structure comprises a cross-fire tube configured to extend between the gas turbine combustor and another gas turbine combustor, a flame detector, a spark plug, a boss, a spacer, a pressure probe, a late lean injector, a sensor, or a combination thereof.

13. A system, comprising:

a gas turbine engine, comprising:

a turbine wake reducer configured to reduce a wake in a wake region downstream from a structure obstructing a gas flow of the gas turbine engine, wherein the turbine wake reducer comprises:

a flow control wall configured to surround the structure;

an upstream opening configured to intake a portion of the gas flow into an intermediate passage between the flow control wall and the structure; and a downstream opening configured to exhaust the portion of the gas flow into the wake region; and a fuel injector disposed downstream of the turbine wake reducer and the structure, wherein the fuel injector is configured to obstruct the gas flow downstream from the turbine wake reducer and the structure.

14. The system of claim 13, wherein the flow control wall is an airfoil shaped wall.

15. The system of claim 13, comprising the structure, wherein the structure comprises an internal flow passage.

16. The system of claim 13, wherein the gas turbine engine comprises:

a combustion liner disposed about a combustion region;

a flow sleeve disposed about the combustion liner; and a gas passage between the combustion liner and the flow sleeve, wherein the structure obstructs the gas flow through the gas passage.

17. The system of claim 13, comprising an intermediate passage between the upstream opening and the downstream opening, wherein the intermediate passage is defined between the structure and the turbine wake reducer.

18. A method, comprising:

reducing, via a wake reducer, a wake in a wake region downstream from a structure that obstructs an airflow between a combustion liner and a flow sleeve of a gas turbine combustor, wherein reducing the wake comprises redirecting a portion of the airflow from an upstream opening that intakes a portion of the airflow, through an intermediate passage defined between the structure and the wake reducer, and out through a downstream opening that exhausts the portion of the airflow into the wake region.

19. The method of claim 18, comprising flowing the portion of the airflow along a curved path between a flow control wall and the structure, wherein the flow control wall surrounds the structure.

* * * * *